US008814724B2

(12) United States Patent
Kato

(10) Patent No.: US 8,814,724 B2
(45) **Date of Patent: *Aug. 26, 2014**

(54) GOLF CLUB

(75) Inventor: Akira Kato, Kobe (JP)

(73) Assignee: SRI Sports Limited, Kobe (JP)

( * ) Notice: Subject to any disclaimer, the term of this patent is extended or adjusted under 35 U.S.C. 154(b) by 210 days.

This patent is subject to a terminal disclaimer.

(21) Appl. No.: 13/338,772

(22) Filed: Dec. 28, 2011

(65) Prior Publication Data

US 2012/0172145 A1 Jul. 5, 2012

(30) Foreign Application Priority Data

Dec. 29, 2010 (JP) ..... 2010-294488

(51) Int. Cl.
*A63B 53/00* (2006.01)

(52) U.S. Cl.
USPC ..... 473/346; 473/342; 473/349

(58) Field of Classification Search
USPC ..... 473/349, 346, 342
See application file for complete search history.

(56) References Cited

U.S. PATENT DOCUMENTS

| | | | | |
|---|---|---|---|---|
| 2,087,685 | A * | 7/1937 | Hackney | 473/349 |
| 6,840,872 | B2 * | 1/2005 | Yoneyama | 473/346 |
| 6,899,638 | B2 * | 5/2005 | Iwata et al. | 473/329 |
| 6,926,618 | B2 * | 8/2005 | Sanchez et al. | 473/329 |
| 7,220,190 | B2 * | 5/2007 | Hirano | 473/342 |
| 7,387,579 | B2 * | 6/2008 | Lin et al. | 473/332 |
| 7,442,132 | B2 * | 10/2008 | Nishio | 473/342 |
| 7,494,426 | B2 * | 2/2009 | Nishio et al. | 473/350 |
| 7,614,964 | B2 * | 11/2009 | Matsunaga | 473/342 |
| 7,618,331 | B2 * | 11/2009 | Hirano | 473/329 |
| 7,993,214 | B2 * | 8/2011 | Hirano | 473/329 |
| 8,012,041 | B2 * | 9/2011 | Gibbs et al. | 473/329 |
| 8,070,623 | B2 * | 12/2011 | Stites et al. | 473/329 |
| 8,226,498 | B2 * | 7/2012 | Stites et al. | 473/329 |
| 8,382,609 | B2 * | 2/2013 | Yokota | 473/346 |
| 8,439,769 | B2 * | 5/2013 | Rice et al. | 473/329 |
| 8,465,379 | B2 * | 6/2013 | Wada et al. | 473/329 |
| 8,469,834 | B2 * | 6/2013 | Wada et al. | 473/346 |
| 8,574,095 | B2 * | 11/2013 | Hirano | 473/329 |
| 2001/0051548 | A1 | 12/2001 | Iwata et al. | |
| 2003/0144079 | A1 * | 7/2003 | Yoneyama | 473/346 |
| 2003/0220157 | A1 * | 11/2003 | Dennis et al. | 473/342 |
| 2004/0132544 | A1 * | 7/2004 | Doi | 473/345 |
| 2004/0235585 | A1 * | 11/2004 | Sanchez et al. | 473/346 |
| 2005/0009624 | A1 * | 1/2005 | Long | 473/329 |
| 2006/0111201 | A1 * | 5/2006 | Nishio et al. | 473/346 |
| 2006/0194644 | A1 * | 8/2006 | Nishio | 473/329 |

(Continued)

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A golf club has a reverse flex is 80 to 110 mm. The face portion includes a central thick part, a toe-crown-side thin part on a crown-side and on a toe-side of the central thick part, and a heel-sole-side thin part on a sole-side and on a heel-side the central thick part. In the front view of the head, a first straight line passing an area centroid of the toe-crown-side thin part and an area centroid of a back surface of the face portion has an angle θA of 38 to 45 degrees, and a second straight line passing an area centroid of the heel-sole-side thin part and the area centroid of the back surface of the face portion has an angle θB of 40 to 45 degrees, each with respect to the horizontal plane.

8 Claims, 9 Drawing Sheets

(56) References Cited

U.S. PATENT DOCUMENTS

| | | | | |
|---|---|---|---|---|
| 2007/0015601 | A1* | 1/2007 | Tsunoda et al. | 473/346 |
| 2008/0004127 | A1* | 1/2008 | Takeuchi | 473/292 |
| 2008/0004129 | A1* | 1/2008 | Lin et al. | 473/332 |
| 2008/0125246 | A1* | 5/2008 | Matsunaga | 473/346 |
| 2009/0253533 | A1* | 10/2009 | Hirano | 473/345 |
| 2009/0258724 | A1* | 10/2009 | Rice | 473/329 |
| 2010/0105501 | A1* | 4/2010 | Wada et al. | 473/346 |
| 2010/0304889 | A1* | 12/2010 | Wada et al. | 473/346 |
| 2011/0028243 | A1* | 2/2011 | Matsunaga et al. | 473/349 |
| 2011/0201451 | A1* | 8/2011 | Wada et al. | 473/346 |
| 2012/0108359 | A1* | 5/2012 | Abe | 473/345 |
| 2012/0165117 | A1* | 6/2012 | Abe | 473/345 |

* cited by examiner

GOLF CLUB

BACKGROUND OF THE INVENTION

The present invention relates to a golf club which can control a decrease in the rebound performance on off-center hit by defining a thickness distribution of a face portion in consideration of a toe down during swing, more particularly to a golf club which can be suitably used by average golfers whose head speed is 45 to 55 m/s.

In recent years, there has been proposed a golf club head having a hollow structure comprising a face portion provided with a central thick part and a thin part surrounding the central thick part for example as disclosed in Japanese patent application publication No. JP-2010-104473-A and PCT publication No. WO 01/083049. Owing to the thin part, such a golf club has an advantage such that a decrease in the rebound of the ball on off-center hit can be controlled.

By the way, as shown in FIG. 10, due to the structure of the golf club (a), the center G of gravity of the club head (b) is positioned at a certain distance from the center line (d) of the shaft (c). Accordingly, during swing, due to the centrifugal force, the club head (b) moves closer to the swing plane. As a result, the shaft (c) is bent, and the toe b1 of the club head (b) comes down (toward the ground) when compared with the position at address. Thus, so called toe-down phenomenon is caused. With increase in the toe-down, the golf ball hitting positions vary wide in the toe-heel direction of the face. The present inventor, therefore, studied on the toe-down during swing quantitatively in relation to the reverse flex of the club, and discovered that the decrease in the rebound performance on off-center hit can be minimized by specifically defining the thickness distribution of the face portion based on the reverse flex.

SUMMARY OF THE INVENTION

The present invention was studied out with the view to the current conditions stated above and mainly intended to provide a golf club which control the decrease in the rebound performance on off-center hit by defining a distribution of thin parts suitably for variations of ball-hitting-positions based on the reverse flex.

According to the present invention, a golf club comprises:

a shaft; and a golf club head with a hollow structure fixed to one end side of the shaft and including a face portion having a face for hitting a ball, wherein a reverse flex is 80 to 110 mm, the face portion includes a central thick part provided in a central region, a toe-crown-side thin part of a small thickness provided on a crown-side and on a toe-side of the central thick part, and a heel-sole-side thin part of a small thickness provided on a sole-side and on a heel-side the central thick part, and in a front view in a standard state put on a horizontal plane at a specified lie angle and loft angle, a first straight line passing an area centroid of the toe-crown-side thin part and an area centroid of a back surface of the face portion has an angle θA of 38 to 45 degrees with respect to the horizontal plane, and a second straight line passing an area centroid of the heel-sole-side thin part and the area centroid of the back surface of the face portion has an angle θB of 40 to 45 degrees with respect to the horizontal plane.

Further, it is also possible that the toe-crown-side thin part and the heel-sole-side thin part have a thickness of 1.8 to 2.4 mm, the area of the toe-crown-side thin part is 5 to 9% of the overall area of the back surface of the face portion, and the area of the heel-sole-side thin part is 3 to 8% of the overall area of the back surface of the face portion, that the volume of the golf club head is 400 to 470 cc, and that the golf club head is of a wood-type.

Thus, the golf club according to the present invention is a golf club comprising the shaft and the golf club head with the hollow structure fixed to one end side of the shaft and including the face portion having the face for hitting a ball, and the reverse flex is limited to 80 to 110 mm. In such golf club, when swung at a head speed of not less than 45 m/s, more specifically 45 to 55 m/s for example, the amount of toe down falls within a substantially fixed range. Therefore, based on this, it is possible to estimate the range of variations of ball-hitting-positions in the toe-heel direction of the face portion. Therefore, according to the present invention, in the front view of the club in a standard state put on a horizontal plane at a specified lie angle and loft angle, the angle θA of the first straight line passing the area centroid of the toe-crown-side thin part of the face portion and the area centroid of the back surface of the face portion is limited to 38 to 45 degrees with respect to the horizontal plane, and the angle θB of the second straight line passing the area centroid of the heel-sole-side thin part and the area centroid of the back surface of the face portion is limited to 40 to 45 degrees with respect to the horizontal plane. In such golf club head, the thin parts of the face portion whose rebound characteristic is high are arranged in a specific distribution suitable for the variations of the ball-hitting-positions caused by the toe down corresponding to the amount of the toe down, therefore, the decrease in the rebound performance on off-center hit can be minimized.

DESCRIPTION OF THE PREFERRED EMBODIMENTS

Figure 1:
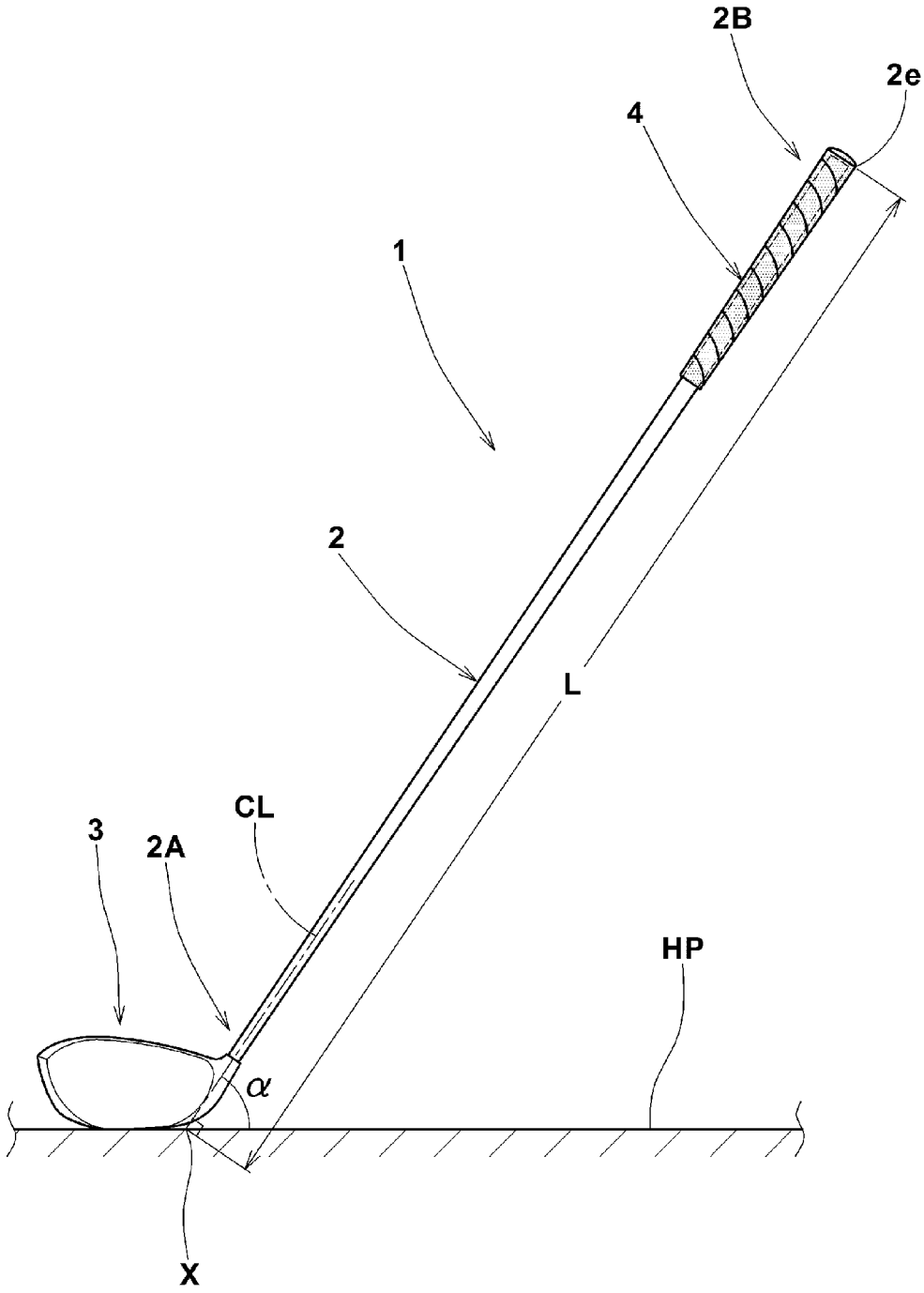
FIG. 1 is a front view of a golf club according to an embodiment of the present invention in its standard state.

An embodiment of the present invention will now be described in detail in conjunction with accompanying drawings.

In the drawings, a golf club 1 according to the present invention comprises a shaft 2, a golf club head 3 attached to one end side 2A of the shaft 2, and a grip 4 attached to the other end side 2B of the shaft 2.

Figure 2:
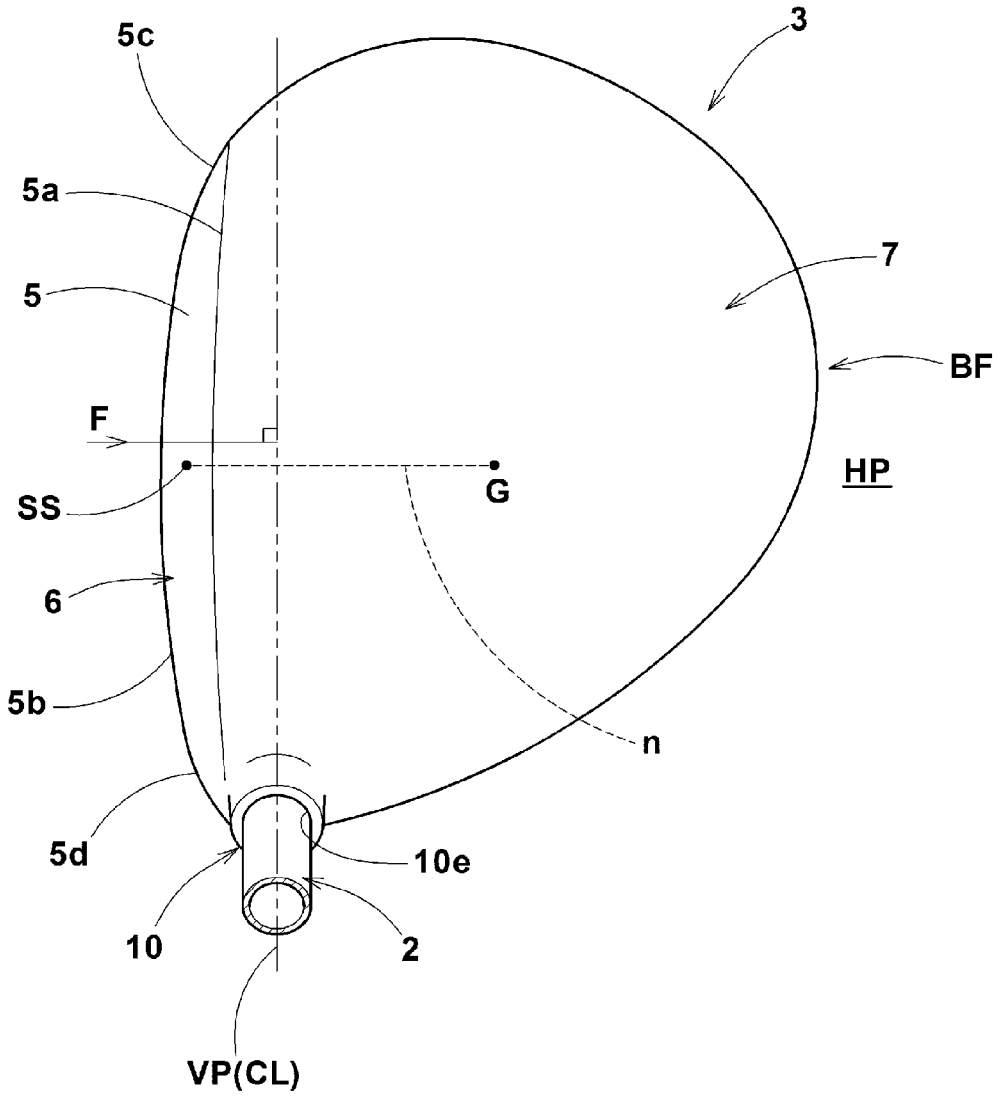
FIG. 2 is a partial plan view of the golf club shown in FIG. 1.

In this embodiment, as shown in FIG. 1 and FIG. 2, the golf club head 3 is formed as a wood-type golf club head such as for driver (#1), spoon (#3) and the like.

In FIG. 1 and FIG. 2, shown is the golf club 1 in its standard state. The standard state is such that the golf club head is placed on a horizontal plane HP so that the center line CL of the golf shaft 2 is inclined at its lie angle α while keeping the center line CL on a vertical plane VP, and the face 5 (at the sweet spot SS) forms its loft angle with respect to the horizontal plane HP. In the description, the golf club is described based on that it is being in the standard state unless otherwise noted. The loft angle is given as being more than 0 degree. The sweet spot SS is the point of intersection between the face 5 and a straight line n drawn normally to the face from the center of gravity G of the golf club head.

The club length L of the golf club 1 in this embodiment is not limited. But, if the club length L of the golf club 1 becomes excessively increased, the swing balance becomes worse, and variations of ball-hitting-positions increase. If the club length L becomes excessively decreased, it becomes difficult to increase the golf club head speed by utilizing the club length. In this light, the club length L is preferably not less than 45 inches, more preferably not less than 45.5 inches, but not more than 47 inches, more preferably not more than 46.5 inches.

The club length L of the golf club 1 is, as shown in FIG. 1, a length L measures along the center line CL of the shaft 2 from the grip side end 2*e* of the shaft 2 to the intersecting point X of the center line CL of the shaft 2 with the horizontal plane HP in the standard state.

It is preferable that the shaft 2 is made of a fiber reinforced resin material. Such shaft 2 is lightweight and thereby it is easy to swing through the golf ball, and it has a high flexibility in designing such as adjusting of the weight balance and the amount of deflection and the like, therefore, it is desirable. However, a metal material may be used for the shaft 2.

Figure 3:
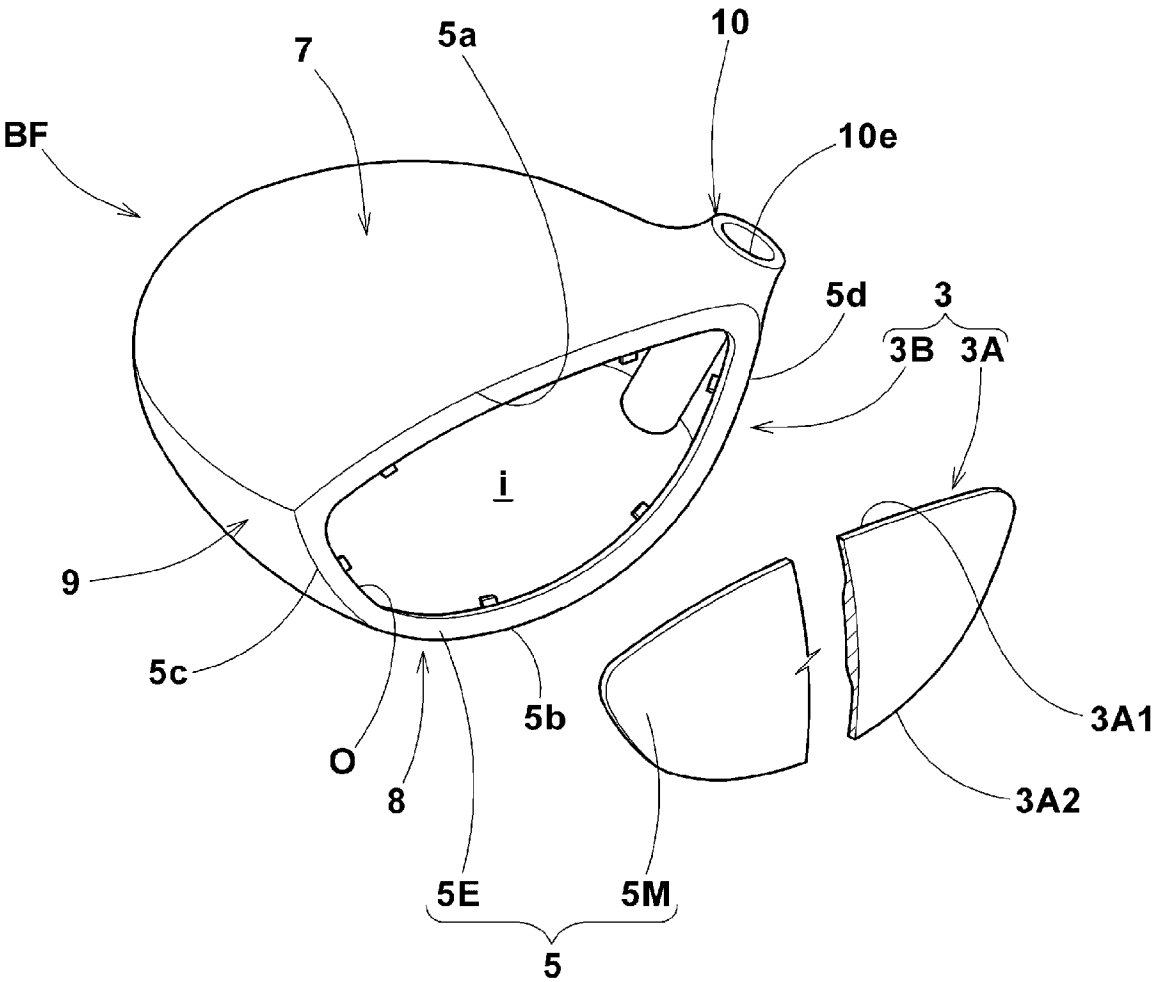
FIG. 3 is an exploded perspective view of the golf club head before assembled.

As shown in FIGS. 2 and 3, the club head 3 comprises a face portion 6 of which front surface defines a face 5 for striking the golf ball, a crown portion 7 defining the top surface of the club head intersecting the face 5 at the upper edge 5*a* thereof, a sole portion 8 defining the bottom face of the club head intersecting the face 5 at the lower edge 5*b* thereof, a side portion 9 between the crown portion 7 and sole portion 8 extending from the toe-side edge 5*c* of the face 5 to the heel-side edge 5*b* of the face 5 passing through the back face BF of the golf club head, and a tubular hosel portion 10 having a shaft inserting hole 10*e* positioned on the heel-side of the crown portion 7. And the club head 3 is constructed as a hollow structure provided therein with a hollow (i).

The club head 3 may have a two-piece structure, three-piece structure, four-piece structure and the like. In this embodiment, as shown in FIG. 3, the club head 3 has a two-piece structure composed of a main body member 3B and a face member 3A attached to the front of the main body member 3B and forming the face portion 6. The face member 3A and the main body member 3B can be made from various metal materials. For example, one or two or more kinds of titanium alloys, stainless steel or steel alloys, and the like can be suitably used. In combination with such metal material(s), a light weight material having a specific gravity lower than the metal material(s) such as fiber reinforced resin can be used to form a part of the club head 3.

In this embodiment, the face member 3A is formed in the form of a plate for example to have a contour shape smaller than the shape defined by the peripheral edges 5*a*-5*d* of the face 5 and to define a major part 5M of the face. In the face member 3A in this embodiment, all portions are integrally formed by pressing a rolled material to cause a plastic deformation for example. Further, the face member 3A is constructed by a crown-side edge 3A1 formed on the crown-side of the face member 3A and a sole-side edge 3A2 formed ON the sole-side of the face member 3A.

The main body member 3B includes the part of the club head 3 excluding the face member 3A. More specifically, the main body member 3B includes an outer part 5E of the face portion between the peripheral edges 5*a*-5*d* of the face 5 and the opening 0 in addition to the crown portion 7, the sole portion 8, the side portion 9 and the hosel portion 10. Accordingly, the face 5 of the club head 3 in this embodiment is defined by the face's major part 5M of the face member 3A and the outer surface of the outer part 5E of the main body member 3B. It is preferable that all portions of the main body member 3B are integrally formed by casting for example.

If the volume V of the club head 3 is excessively decreased, a sweet spot area becomes decreased, and the rebound of a ball on off-center hit is liable to decrease. If the volume V is excessively increased, as the mass of the club head increases, it becomes difficult to swing through the ball and the golf club head speed decreases. In this light, the volume V is preferably set in a range of not less than 400 cc, more preferably not less than 410 cc, but not more than 470 cc, more preferably not more than 460 cc.

If the mass of the club head 3 is excessively decreased, the kinetic energy of the club head decreases, and it becomes difficult to improve the carry distance. If the mass of the club head 3 is excessively increased, it becomes difficult to swing through the ball and the carry distance tends to decrease. In this light, the mass of the club head 3 is preferably set in a range of not less than 180 g, more preferably not less than 185 g, but not more than 210 g, more preferably not more than 200 g.

The grip 4 is formed from a vulcanized rubber made from natural rubber, oil, carbon black, sulfur, zinc oxide and the like for example, it is preferable that such grip 4 has a mass of 38 to 46 g.

According to the present invention, the golf club is designed to minimize the decrease in the carry distance on off-center hit when the golf club head speed is 45 to 55 m/s, and thus it can be suitably used by powerful average golfers such as young golfers for example. Based on this standpoint, the reverse flex Ry of the golf club 1 is set in a range of from 80 to 110 mm.

Figure 4:
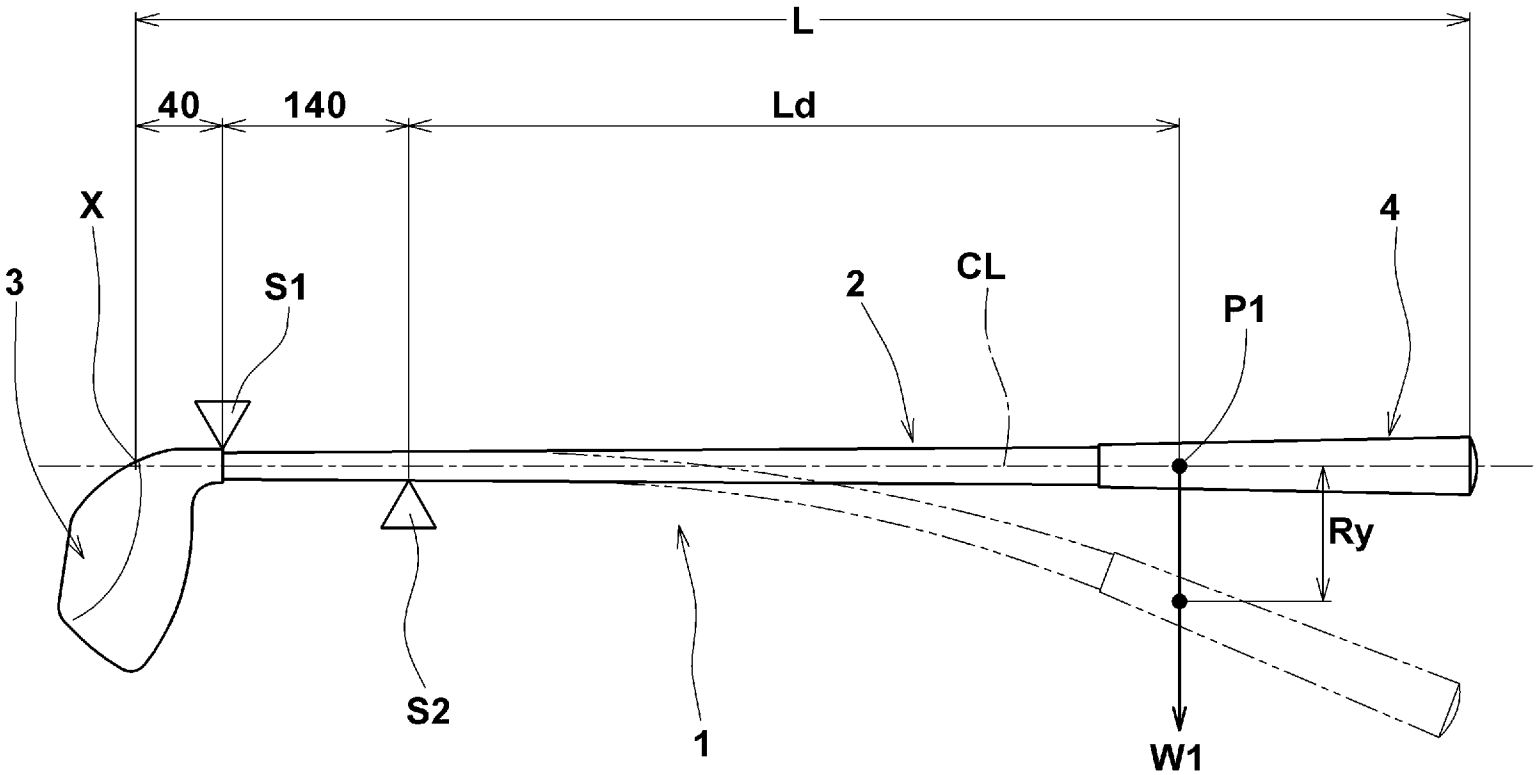
FIG. 4 is a diagram for explaining a method for measuring the reverse flex.
Figure 5A:
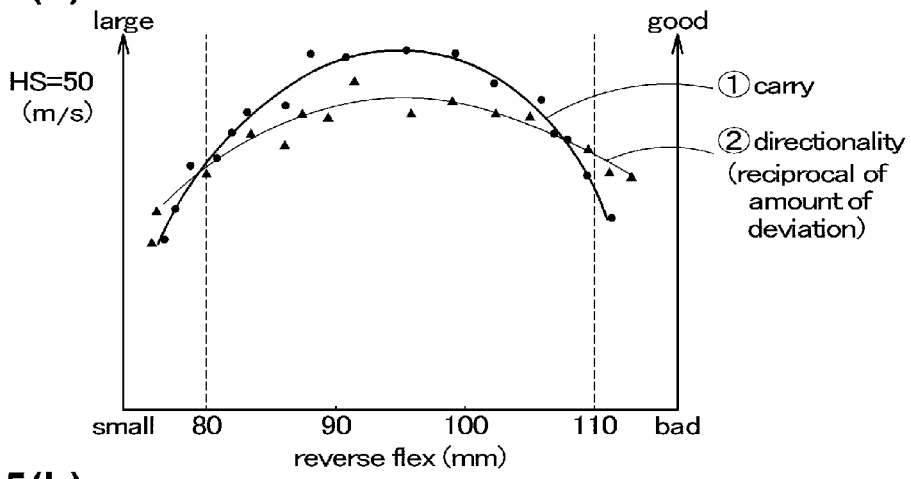
FIGS. 5(*a*)-5(*c*) are graphs showing correlations of the reverse flex and the carry distance and directionality at each head speed.
Figure 5B:
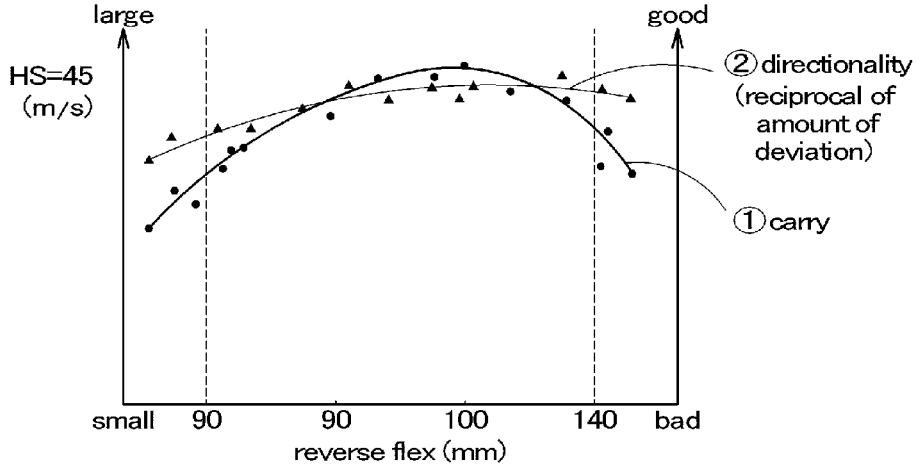
Figure 5C:
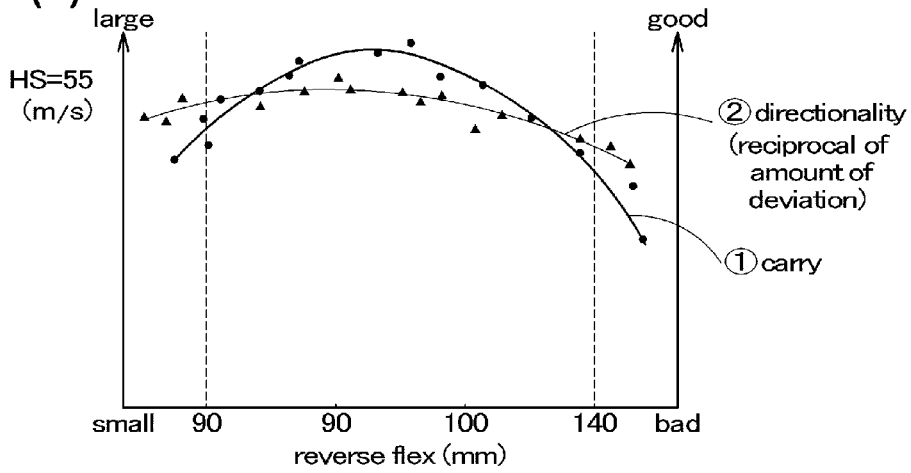

The reverse flex Ry is, as shown in FIG. 4, the amount of deflection of the club measured at a point Pi on the grip side as a displacement in the vertical direction when the club 1 is supported at points S1 and S2 on the club head side so that the center line CL of the shaft 2 becomes parallel with the horizontal direction and a load W1 of 1.25 kgf is applied downwardly to the above-mentioned point P1, wherein the point S1 is positioned at 40 mm from the above-mentioned intersecting point X (shown in FIG. 1), the point S2 is positioned at 140 mm from the point S1, the point P1 is positioned at a distance Ld from the point S2, and the distance Ld is as follows:

driver (#1): 860 mm
brassie (#2): 847 mm
spoon (#3): 835 mm
baffy (#4): 822 mm
cleek (#5): 809 mm
(#7): 796 mm FIGS. 5(*a*)-5(*c*) show results of actual ball hitting tests carried out by ten golfers whose average head speed was 43 m/s, ten golfers whose average head speed was 45 m/s and ten golfers whose average head speed was 55 m/s. In the tests, the reverse flex Ry was changed, but other specifications were not changed, (club length 45.25 inches, club mass 320 g, loft angle 10.0 degrees, head volume 455 cc, thick part thickness 3.4 mm, thin part thickness 2.0 mm) As apparent from the test results, when the reverse flex Ry is less than 80 mm, the shaft 2 becomes hard even for the golfers with fast head speed, and in the above head speed range, it is difficult to appropriately bend the shaft to obtain a sufficient carry distance, and further, it becomes difficult for the face 5 to return its direction to that at the address. Thus, the directional stability of the struck balls becomes worse. If the reverse flex exceeds 110 mm, as the shaft 2 becomes soft for the golfers of the above-mentioned head speed range, it becomes difficult to stably control the direction of the face 5, therefore, the directional stability of the struck balls is remarkably deteriorated. In this light, the reverse flex is more preferably not less than 90 mm, but more preferably not more than 100 mm. As explained above, in the present invention, the reverse flex Ry is optimized based on the high head speed range of powerful golfers to obtain a sufficient carry distance and directional stability.

Such reverse flex Ry can be easily adjusted within the above range by changing the kind of the material of the shaft 2, the elastic modulus of the material of the shaft 2 and the like.

The present inventor discovered through experiments that, by specifically arranging the thickness distribution of the face portion 6 in relation to the reverse flex Ry in the above range, it is possible to avoid the decrease in the carry distance on off-center hit. More specifically, when the golfers whose average head speed ranges from 45 to 55 m/s use golf clubs having a reverse flex of from 80 to 110 mm, the amount of toe down falls in a substantially fixed range, and the range of variations of ball-hitting-positions on the face is also substantially fixed, therefore, the decrease in the carry distance (rebound performance) on off-center hit can be minimized by increasing the restitution coefficient locally in such variations' range of the face portion 6.

Next, such thickness distribution capable of increasing the rebound performance will be described concretely.

Figure 6:
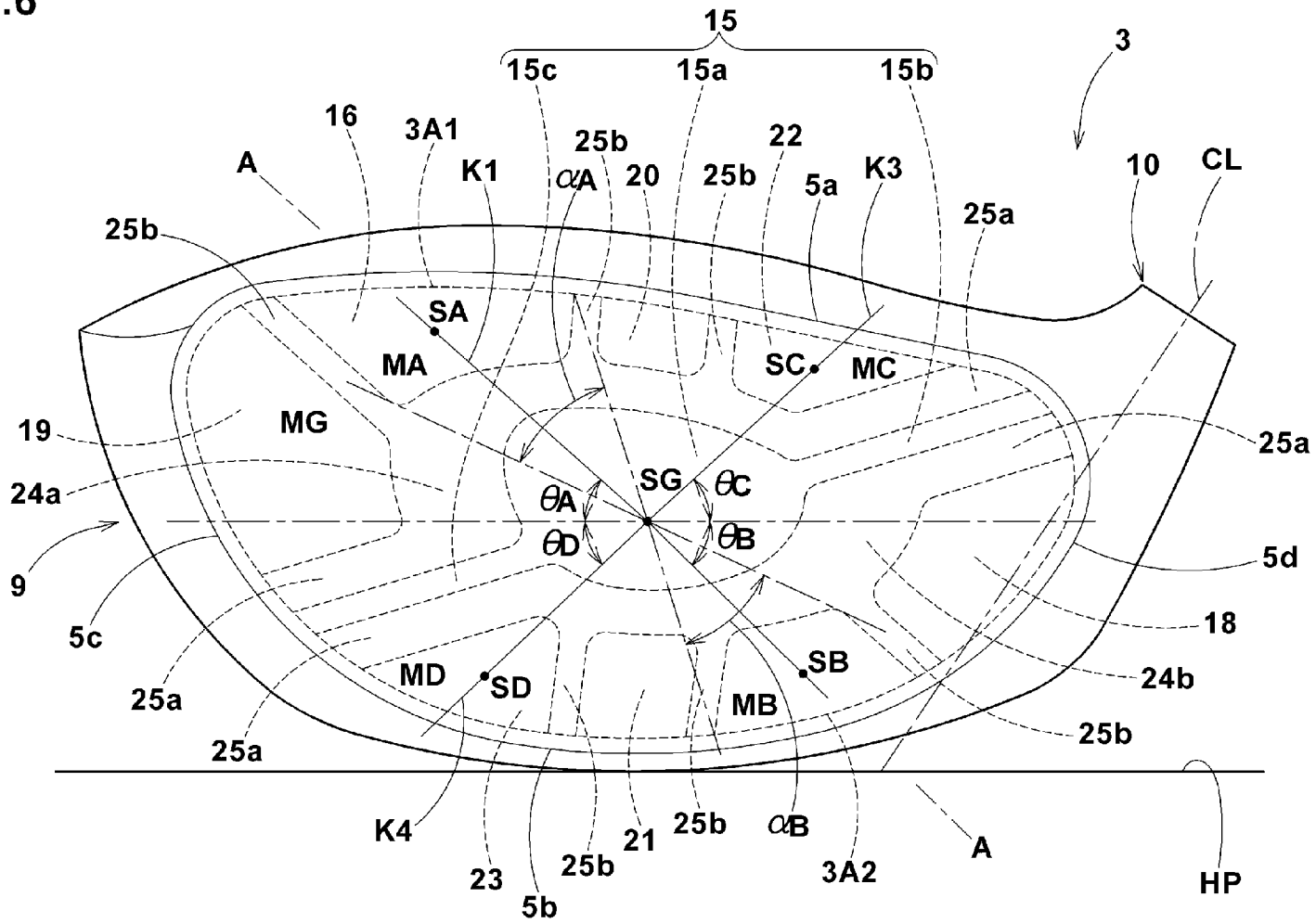
FIG. 6 is a front view of FIG. 2.
Figure 7:
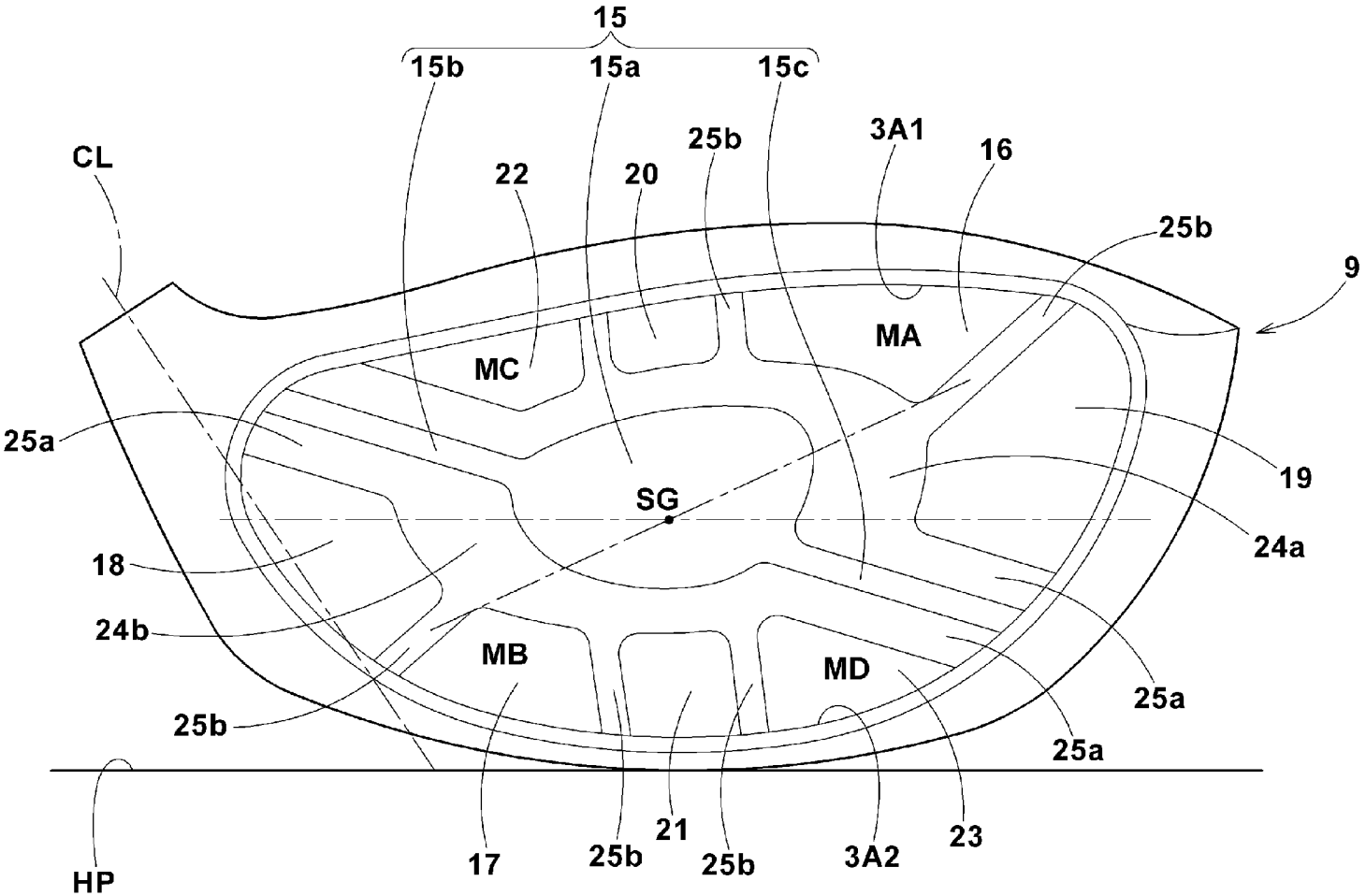
FIG. 7 is a back view of a face member showing the back surface of the face portion.
Figure 8:
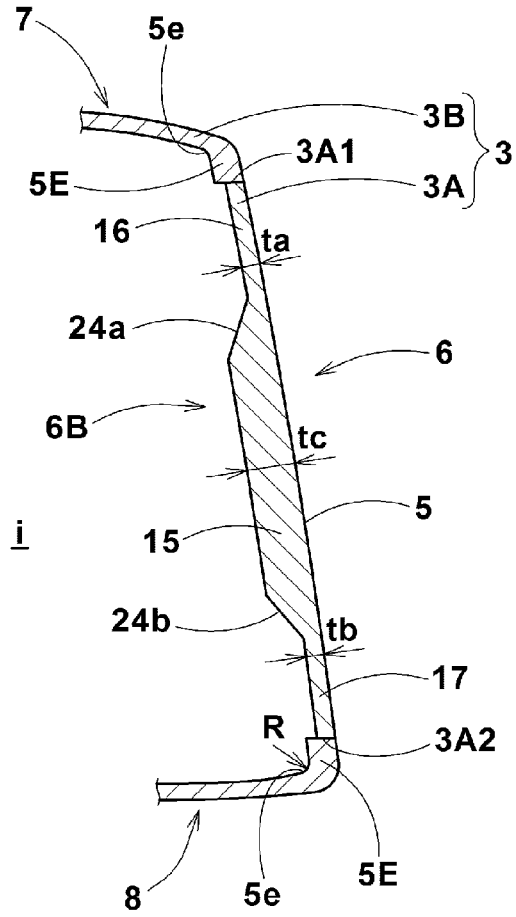
FIG. 8 is an enlarged A-A sectional view of FIG. 6.

In FIG. 6, the front view of the face member 3A under the standard state is shown. FIG. 7 shows the back surface 6B of the face member 3A. FIG. 8 shows the cross section of the face member 3A taken along line A-A in FIG. 6. As shown, the face 5 is smooth except for face grooves, punch marks and the like (not shown). In contrast, the back surface 6B of the face portion 6 is nonsmooth so that the face portion 6 has a specific thickness distribution.

In this embodiment, the face portion 6 comprises a central thick part 15 including the sweet spot SS, a toe-crown-side thin part 16 on the toe-side and on the crown-side of the central thick part 15, a heel-sole-side thin part 17 on the heel-side and on the sole-side of the central thick part 15, a heel-side middle thickness part 18 on the heel-side of the central thick part 15, a toe-side middle thickness part 19 on the toe-side of the central thick part 15, a crown-side middle thickness part 20 on the crown-side of the central thick part 15, a sole-side middle thickness part 21 on the sole-side of the central thick part 15, a heel-crown-side thin part 22 between the crown-side middle thickness part 20 and the central thick part 15, and a toe-sole-side thin part 23 between the sole-side middle thickness part 21 and the central thick part 15.

The central region of the face portion 6 is subjected to a large impulsive force when hitting a ball. Therefore, in order to improve the durability of the face portion 6, the central thick part 15 has a largest thickness in the face portion 6. Here, the central region of the face portion 6 is a region having a certain area including the area centroid SG of the contour shape at the peripheral edge 5*e* of the back surface of the face portion 6 facing the hollow (i). The peripheral edge 5*e* of the back surface of the face portion is, as shown in FIGS. 7 and 8, given as a boundary line between the back surface 6B of the face portion 6 and the inner surfaces of the crown portion 7, sole portion 8 and side portion 9. If the back surface 6B is connected to the inner surfaces of the portions 7-9 through an arc like a chamfer to prevent stress concentration, then for the purpose of convenience, the peripheral edge 5*e* of the back surface of the face is defined as the midpoint of the length of the arc R in a cross section of the club head.

In this embodiment, the central thick part 15 is composed of a base 15*a* which is generally a horizontally long oval along the contour shape of the peripheral edge 5*e* of the back surface of the face portion, an upward rib 15*b* extending from an upper part of the base 15*a* on its heel-side to the crown-side edge 3A1 while inclining to the heel-side, and a downward rib 15*c* extending from a lower part of the base 15*a* on its toe-side to the sole-side edge 3A2 while inclining to the toe-side. Owing to the base 15*a*, such central thick part 15 has an advantage capable of securing the durability of the central portion region which is most deflectable in the face 5. Both of the ribs 15*b* and 15*c* improve the durability of the face portion 6 as a whole.

In order to certainly improve the durability of the face portion 6, the thickness tc of the central thick part 15 is set to be preferably not less than 3.4 mm, more preferably not less than 3.5 mm. On the other hand, if the thickness tc of the central thick part 15 becomes excessively increased, there is a possibility of deterioration in the rebound performance and that, due to the increased face weight, the swing balance is disturbed and ball-hitting-positions vary wide. In this light, the thickness tc of the central thick part 15 is preferably not more than 4.0 mm, more preferably not more than 3.9 mm. It is preferable that the central thick part 15 is formed to have a substantially constant thickness.

In this embodiment, the thickness of the upward rib 15*b* and the thickness of the downward rib 15*c* are substantially the same as the thickness of the base 15*a*. However, it may be possible that, in order to reduce the mass of the club head 3, the thickness of the upward rib 15*b* is gradually decreased toward the crown-side, and the thickness of the downward rib 15*c* is gradually decreased toward the sole-side.

In order to secure the durability of the face portion 6 and suppress the deterioration in the rebound performance and the increase in the weight of the face portion, the area MT of the central thick part 15 is preferably set in a range of not less than 10%, more preferably not less than 15%, but not more than 35%, more preferably not more than 30% of the overall area MG of the back surface 6B of the face portion 6. For the sake of convenience, the areas of the back surface 6B of the face portion 6 and the central thick part 15 (as well as the areas of the after-mentioned parts 16-23) are each defined by an area obtained by a two-dimensional shape of such region or part projected on the vertical plane VP shown in FIG. 2 (or a vertical plane parallel thereto).

The overall area MG of the back surface 6B is set based on the volume of the club head 3 but preferably set in a range of not less than 33 sq.cm, more preferably not less than 35 sq.cm, but not more than 53 sq.cm, more preferably not more than 47 sq.cm.

The toe-crown-side thin part 16 and the heel-sole-side thin part 17 are formed to have a constant thickness in this embodiment, and have the smallest thickness in the face portion 6. Therefore, even if the ball hitting positions is in a toe-side or heel-side in the face 5, namely, on off-center hit, the face portion 6 makes a large elastic deformation, and the decrease in the rebound performance and the decrease in the carry distance can be avoided.

Figure 9:
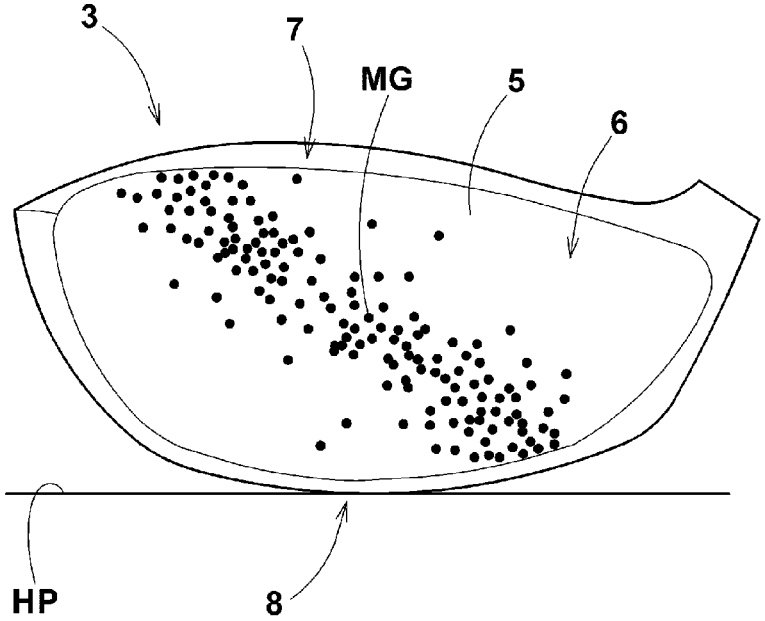
FIG. 9 shows an example of distributions of ball-hitting-positions of average golfers.
Figure 10:
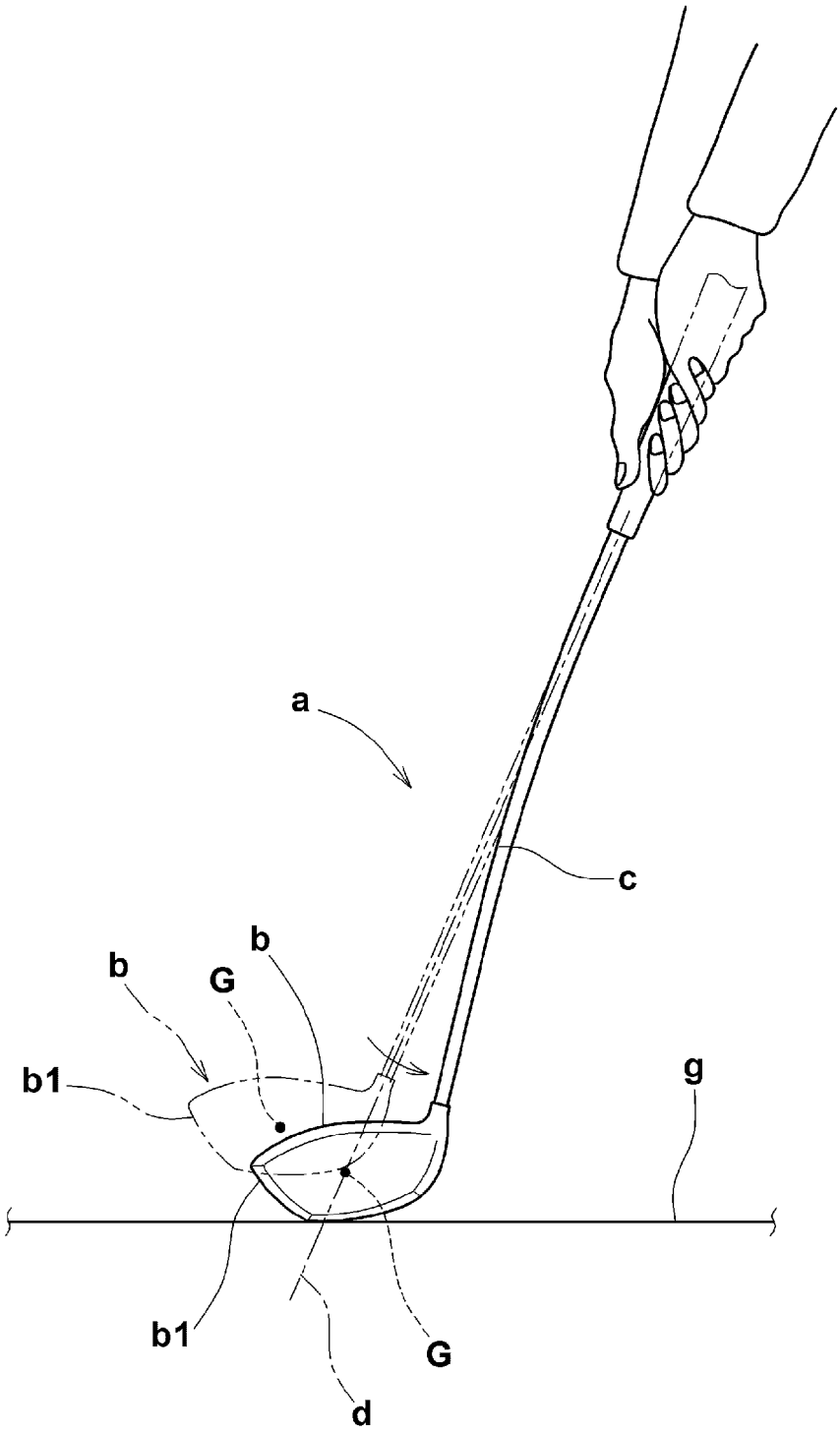
FIG. 10 is a front view for explaining the toe down.

Through experiments conducted by the inventor, it was discovered that, when golfers whose head speed ranges from 45 to 55 m/s use golf clubs having a reverse flex Ry of from 80 to 110 mm, the amount of toe down falls within a substantially fixed range. FIG. 9 shows ball hitting positions of such golfers. As shown, the ball hitting positions of the golfers whose head speed is relatively high have a tendency to vary from the area centroid SG of the back surface 6B toward the toe-side at a certain angle and toward the heel-side at a certain angle. In the golf club 1 according to the present invention, therefore, the toe-crown-side thin part 16 and the heel-sole-side thin part 17 are formed to accord with this distribution in order to minimize the decrease in the rebound performance due to the variations of the ball-hitting-positions.

Concretely speaking, as shown in FIG. 6, in the front view under the standard state, a first straight line K1 passing the area centroid SA of the toe-crown-side thin part 16 and the area centroid SG of the back surface 6B of the face portion 6 has to have an angle θA of from 38 to 45 degrees with respect to the horizontal plane HP, and a second straight line K2 passing the area centroid SG and the area centroid SB of the heel-sole-side thin part 17 has to have an angle θB of from 40 to 45 degrees with respect to the horizontal plane HP. Thereby, it becomes possible to arrange the toe-crown-side thin part 16 and the heel-sole-side thin part 17 in suitable positions corresponding to the variations of ball hitting positions according to the amount of toe down of the golf club 1 occurring due to the reverse flex. The above-mentioned front view is specified as the shape of the club head 3 when the face 5 is viewed form a direction orthogonal to the vertical plane VP as shown in FIG. 2 by symbol F. The area centroids SA, SB and SG are obtained based on the after-mentioned areas MA, MB and MG.

If the angle θA is less than 38 degrees or more than 45 degrees or the angle θB is less than 40 degrees or more than 45 degrees, then the positions of the thin parts 16 and 17 do not match with the ball-hitting-positions corresponding to the amount of toe down, and the rebound performance on off-center hit is decreased. In this light, the angle θA is preferably not less than 40 degrees, but not more than 43 degrees, and the angle θB is preferably not less than 42 degrees, but not more than 44 degrees.

If the thickness ta of the toe-crown-side thin part 16 and the thickness tb of the heel-sole-side thin part 17 are excessively decreased, there is a possibility that the durability of the face 5 is deteriorated. If excessively increased, there is a possibility that the rebound performance is deteriorated. Therefore, the thicknesses ta and tb of the thin parts 16 and 17 are preferably set in a range of not less than 1.7 mm, more preferably not less than 1.8 mm, but not more than 2.4 mm, more preferably not more than 2.2 mm. If the face 5 is provided with face grooves and/or punch marks, the thickness of each part of the face portion 6 is measured in such a condition that the face grooves and punch marks are filled.

If the area MA of the toe-crown-side thin part 16 and the area MB of the heel-sole-side thin part 17 become decreased, there is a possibility that the improvement in the rebound performance of the club head becomes insufficient. If the area MA and area MB become increased, there is a possibility that the durability of the club head 3 is decreased. In this light, the area MA of the toe-crown-side thin part 16 is preferably set in a range of not less than 5%, more preferably not less than 6%, but not more than 9%, more preferably not more than 8% of the overall area MG of the back surface 6B. And the area MB of the heel-sole-side thin part 17 is preferably set in a range of not less than 3%, more preferably not less than 4%, but not more than 8%, more preferably not more than 7% of the overall area MG of the back surface 6B. Especially, it is preferable that the area MA of the toe-crown-side thin part 16 is more than the area MB of the heel-sole-side thin part 17.

In this embodiment, the toe-crown-side thin part 16 is formed in a region between two straight lines intersecting at the area centroid SG at an angle αA. This angle αA is preferably set in a range of not less than 30 degrees, more preferably not less than 35 degrees, but not more than 55 degrees, more preferably not more than 50 degrees. Similarly, the heel-sole-side thin part 17 is formed in a region between two straight lines intersecting at the area centroid SG at an angle αB. This angle αB is preferably set in a range of not less than 30 degrees, more preferably not less than 35 degrees, but not more than 50 degrees, more preferably not more than 45 degrees. Thereby, the rebound performance and the durability of the face 5 can be improved in a well balanced manner.

It is preferable that the face portion 6 is provided with a toe-sole-side thin part 23, and a heel-crown-side thin part 22 having a thickness same as those of the thin parts 16 and 17. It is preferable that a third straight line K3 passing the area centroid SC of such heel-crown-side thin part 22 and the area centroid SG of the back surface 6B of the face portion 6 is configured to have an angle θC of 35 to 50 degrees with respect to the horizontal plane HP. Also, it is preferable that a fourth straight line K4 passing the area centroid SB of the toe-sole-side thin part 23 and the area centroid SG is configured to have an angle θD of 40 to 50 degrees with respect to the horizontal plane HP. Therefore, in the club head 3 in this embodiment, the mass of a region far from ball hitting positions is reduced, and the golf club head speed and the durability can be improved in a well balanced manner. In this light, the angle θC is more preferably not less than 40 degrees, and more preferably not more than 45 degrees. Similarly, the angle θD is more preferably not less than 42 degrees, and more preferably not more than 47 degrees.

It is not to be particularly limited. But, if the area MC of the heel-crown-side thin part 22 and the area MD of the toe-sole-side thin part 23 are decreased, it becomes difficult to achieve the above-mentioned effects. If increased, the durability of the face portion 6 is liable to deteriorate. In this light, the area MC of the heel-crown-side thin part 22 is preferably not less than 2%, more preferably not less than 4% and preferably not more than 10%, more preferably not more than 8% of the overall area MG of the back surface 6B. The area MD of the toe-sole-side thin part 23 is preferably not less than 2%, more preferably not less than 3% and preferably not more than 10%, more preferably not more than 7% of the overall area MG.

The middle thickness parts 18-21 can prevent the occurrence of large rigidity difference between the central thick part 15 and the thin parts 16, 17, 22 and 23, and a stress concentration thereon can be effectively prevented. Thereby, the durability of the face portion 6 can be further improved.

The total area MS of the middle thickness parts 18-21 is preferably not less than 20%, more preferably not less than 30%, but not more than 60%, more preferably not more than 50% of the overall area MG of the back surface 6B of the face portion 6 in order to achieve the durability of the face portion 6 and prevention of weight increase in the club head 3 in a well balanced manner.

From the same viewpoint, the thicknesses of the middle thickness parts 18-21 are preferably not less than 45%, more preferably not less than 50%, but not more than 85%, more preferably not more than 80% of the thickness tc of the central thick part 15.

On the crown-side of the central thick part 15, there is provided with a crown-side central thickness transitional part 24*a* which extends semicircularly and of which thickness is continuously decreased toward the peripheral edge 5*e* of the back surface of the face portion. On the sole-side of the central thick part 15, there is provided with a sole-side central thickness transitional part 24*b* which extends semicircularly and of which thickness is continuously decreased toward the peripheral edge 5*e* of the back surface of the face portion.

Further, between the upward rib 15*b* and the heel-crown-side thin part 22, between the upward rib 15*b* and the heel-side middle thickness part 18, between the downward rib 15*c* and the toe-side middle thickness part 19, and between the downward rib 15*c* and the toe-sole-side thin part 23, there is provided with an outside thickness transitional part 25*a* of which thickness is continuously decreased from the upward rib 15*b* or downward rib 15*c*. Further, between the crown-side middle thickness part 20 and the heel-crown-side thin part 22, between the crown-side middle thickness part 20 and the toe-crown-side thin part 16, and between the toe-side middle thickness part 19 and the toe-crown-side thin part 16, there is provided with a small outside thickness transitional part 25*b* which is narrower in width than the outside thickness transitional part 25*a*. Similarly, between the sole-side middle thickness part 21 and the heel-sole-side thin part 17, between the sole-side middle thickness part 21 and the toe-sole-side thin part 23, and between the heel-sole-side thin part 17 and the heel-side middle thickness part 18, there is provided with a small outside thickness transitional part 25*b*. These thickness transitional parts can prevent the occurrence of large rigidity difference due to the thickness difference and stress concentration is prevented, which helps to improve the durability of the face portion 6. In this embodiment, each thickness transitional part is formed to have a substantially constant width.

A detailed description of the present invention is given as above. The present invention is not to be limited to the above-described specific embodiment. Rather, it can be modified variously if desired.

EMBODIMENTS

In order to confirm the effects of the present invention, carbon shafts (Miyazaki Kusala Blue, flex S) manufactured by SRI sports Limited were attached to wood-type golf club heads (driver) based on the specifications shown in FIG. 6 and Table 1, and wood-type clubs having club lengths of 45 to 47 inches were experimentally produced and tested for the rebound performance. Each of the club heads had a two-piece structure formed by laser welding a main body member as a lost-wax precision casting of Ti-6Al-4V and a plate-like face member as a press molded product of Ti-6Al-4V. They had the same parameters except for the parameters shown in Table 1, and major common specifications are as follows. The angles θA and θB were changed while maintaining a constant club mass.

lie angle alpha: 57.5 degrees
loft angle beta: 10.0 degrees
head volume V: 455 cc
club head mass: 197 g
overall area MG of back surface of face portion: 43 sq.cm
thickness tc of central thick part: 3.7 mm
area ratio MT/MG of central thick part and back surface of face portion: 10 to 35%
thickness to of toe-crown-side thin part: 2.0 mm
area ratio MA/MG of toe-crown-side thin part and back surface of face portion: 5 to 9%
thickness tb of heel-sole-side thin part: 2.0 mm
area ratio MB/MG of heel-sole-side thin part and back surface of face portion: 3 to 8%
thickness of heel-crown-side thin part: 2.0 mm
area ratio MC/MG of heel-crown-side thin part and back surface of face portion: 2 to 10%
thickness of toe-sole-side thin part: 2.0 mm
area ratio MD/MG of toe-sole-side thin part and back surface of face portion: 2 to 10%
thickness of each middle thickness part/thickness of central thick part: 50 to 80%
area ratio MS/MG of total area of middle thickness parts and back surface of face portion: 20 to 60%

In each of the thickness transitional parts, the thickness was smoothly changed.

The test method was as follows.

<Rebound Performance> with respect to each of the above-mentioned test clubs, ten testers (average golfers) (head speed 45 to 55 m/s) each hit ten balls by the use of a golf club having a length selected according to own choice, and the golf club head speed HS immediately before hitting a ball and the initial speed BS of the ball were measured to calculate the average of the speed ratios BS/HS. As to the golf balls, three-piece golf balls commercially available as "XXIO" manufactured by SRI Sports Limited were used. The larger the value, the better the results. The results of the test and other are shown in Table 1. In Table 1, the "toe portion gravity center angle θA" means the angle of the first straight line K1 passing the area centroid SA of the toe-crown-side thin part 16 and the area centroid SG of the back surface 6B of the face portion 6 with respect to the horizontal plane HP. And the "heel portion gravity center angle θB" means the angle of the second straight line K2 passing the area centroid SB of the heel-sole-side thin part 17 and the area centroid SG of the back surface 6B of the face portion 6 with respect to the horizontal plane HP.

TABLE 1

| | Comparative example 1 | Comparative example 2 | Comparative example 3 | Comparative example 4 | Comparative example 5 | Embodiment 1 | Embodiment 2 | Embodiment 3 |
|---|---|---|---|---|---|---|---|---|
| reverse flex (mm) | 70 | 70 | 70 | 80 | 80 | 80 | 80 | 80 |
| toe portion gravity center angle θA (degree) | 38 | 42 | 45 | 42 | 37 | 38 | 42 | 45 |
| heel portion gravity center angle θB (degree) | 43 | 43 | 43 | 39 | 40 | 40 | 40 | 40 |
| rebound performance (BS/HS) [larger value is better] | 1.36 | 1.35 | 1.38 | 1.38 | 1.37 | 1.42 | 1.41 | 1.40 |

TABLE 1-continued

| | Comparative example 6 | Comparative example 7 | Embodiment 4 | Embodiment 5 | Embodiment 6 | Comparative example 8 | Comparative example 9 | Embodiment 7 |
|---|---|---|---|---|---|---|---|---|
| reverse flex (mm) | 80 | 80 | 80 | 80 | 80 | 80 | 80 | 80 |
| toe portion gravity center angle θA (degree) | 46 | 37 | 38 | 42 | 45 | 46 | 37 | 38 |
| heel portion gravity center angle θB (degree) | 40 | 43 | 43 | 43 | 43 | 43 | 45 | 45 |
| rebound performance (BS/HS) [larger value is better] | 1.38 | 1.37 | 1.42 | 1.41 | 1.40 | 1.36 | 1.36 | 1.42 |

| | Embodiment 8 | Embodiment 9 | Comparative example 10 | Comparative example 11 | Comparative example 12 | Comparative example 13 | Embodiment 10 | Embodiment 11 |
|---|---|---|---|---|---|---|---|---|
| reverse flex (mm) | 80 | 80 | 80 | 80 | 90 | 90 | 90 | 90 |
| toe portion gravity center angle θA (degree) | 42 | 45 | 46 | 42 | 42 | 37 | 38 | 42 |
| heel portion gravity center angle θB (degree) | 45 | 45 | 45 | 46 | 39 | 40 | 40 | 40 |
| rebound performance (BS/HS) [larger value is better] | 1.43 | 1.41 | 1.38 | 1.37 | 1.36 | 1.38 | 1.42 | 1.44 |

| | Embodiment 12 | Comparative example 14 | Comparative example 15 | Embodiment 13 | Embodiment 14 | Embodiment 15 | Comparative example 16 | Comparative example 17 |
|---|---|---|---|---|---|---|---|---|
| reverse flex (mm) | 90 | 90 | 90 | 90 | 90 | 90 | 90 | 90 |
| toe portion gravity center angle θA (degree) | 45 | 46 | 37 | 38 | 42 | 45 | 46 | 37 |
| heel portion gravity center angle θB (degree) | 40 | 40 | 43 | 43 | 43 | 43 | 43 | 45 |
| rebound performance (BS/HS) [larger value is better] | 1.42 | 1.38 | 1.37 | 1.43 | 1.44 | 1.42 | 1.37 | 1.36 |

| | Embodiment 16 | Embodiment 17 | Embodiment 18 | Comparative example 18 | Comparative example 19 | Comparative example 20 | Comparative example 21 | Embodiment 19 |
|---|---|---|---|---|---|---|---|---|
| reverse flex (mm) | 90 | 90 | 90 | 90 | 90 | 100 | 100 | 100 |
| toe portion gravity center angle θA (degree) | 38 | 42 | 45 | 46 | 42 | 42 | 37 | 38 |
| heel portion gravity center angle θB (degree) | 45 | 45 | 45 | 45 | 46 | 39 | 40 | 40 |
| rebound performance (BS/HS) [larger value is better] | 1.42 | 1.41 | 1.42 | 1.39 | 1.37 | 1.37 | 1.38 | 1.44 |

| | Embodiment 20 | Embodiment 21 | Comparative example 22 | Comparative example 23 | Embodiment 22 | Embodiment 23 | Embodiment 24 | Comparative example 24 |
|---|---|---|---|---|---|---|---|---|
| reverse flex (mm) | 100 | 100 | 100 | 100 | 100 | 100 | 100 | 100 |
| toe portion gravity center angle θA (degree) | 42 | 45 | 46 | 37 | 38 | 42 | 45 | 46 |
| heel portion gravity center angle θB (degree) | 40 | 40 | 40 | 43 | 43 | 43 | 43 | 43 |
| rebound performance (BS/HS) [larger value is better] | 1.44 | 1.43 | 1.37 | 1.38 | 1.42 | 1.44 | 1.45 | 1.39 |

| | Comparative example 25 | Embodiment 25 | Embodiment 26 | Embodiment 27 | Comparative example 26 | Comparative example 27 | Comparative example 28 | Comparative example 29 | Embodiment 28 |
|---|---|---|---|---|---|---|---|---|---|
| reverse flex (mm) | 100 | 100 | 100 | 100 | 100 | 100 | 110 | 110 | 110 |
| toe portion gravity center angle θA (degree) | 37 | 38 | 42 | 45 | 46 | 42 | 42 | 37 | 38 |
| heel portion gravity center angle θB (degree) | 45 | 45 | 45 | 45 | 45 | 46 | 39 | 40 | 40 |
| rebound performance (BS/HS) [larger value is better] | 1.37 | 1.42 | 1.44 | 1.42 | 1.36 | 1.38 | 1.36 | 1.36 | 1.43 |

| | Embodiment 29 | Embodiment 30 | Comparative example 30 | Comparative example 31 | Embodiment 31 | Embodiment 32 | Embodiment 33 | Comparative example 32 | Comparative example 33 |
|---|---|---|---|---|---|---|---|---|---|
| reverse flex (mm) | 110 | 110 | 110 | 110 | 110 | 110 | 110 | 110 | 110 |
| toe portion gravity center angle θA (degree) | 42 | 45 | 46 | 37 | 38 | 42 | 45 | 46 | 37 |

TABLE 1-continued

| | | | | | | | | | |
|---|---|---|---|---|---|---|---|---|---|
| heel portion gravity center angle θB (degree) | 40 | 40 | 40 | 43 | 43 | 43 | 43 | 43 | 45 |
| rebound performance (BS/HS) [larger value is better] | 1.43 | 1.44 | 1.37 | 1.38 | 1.45 | 1.43 | 1.43 | 1.37 | 1.36 |

| | Embodiment 34 | Embodiment 35 | Embodiment 36 | Comparative example 34 | Comparative example 35 | Comparative example 36 | Comparative example 37 | Comparative example 38 |
|---|---|---|---|---|---|---|---|---|
| reverse flex (mm) | 110 | 110 | 110 | 110 | 110 | 120 | 120 | 120 |
| toe portion gravity center angle θA (degree) | 38 | 42 | 45 | 46 | 42 | 38 | 42 | 45 |
| heel portion gravity center angle θB (degree) | 45 | 45 | 45 | 45 | 46 | 43 | 43 | 43 |
| rebound performance (BS/HS) [larger value is better] | 1.43 | 1.42 | 1.45 | 1.38 | 1.37 | 1.38 | 1.37 | 1.36 |

The average head speed of the testers and the club length used are shown in Table 2.

| tester | average H.S. (m/s) | club length (inch) |
|---|---|---|
| A | 47.6 | 47 |
| B | 49.6 | 45 |
| C | 52.9 | 44 |
| D | 45.7 | 46 |
| E | 54.1 | 43 |
| F | 48.2 | 45 |
| G | 51.3 | 47 |
| H | 50.7 | 46 |
| I | 46.0 | 44 |
| J | 48.1 | 47 |

average H.S.: average head speed of ten swings

From the test results, it can be confirmed that the golf clubs as Embodiments were significantly improved in the rebound performance in comparison with the comparative examples. Further, changing the area ratio MA/MB of the toe-crown-side thin part and heel-sole-side thin part within a range of 200 to 60%, the rebound performance was checked wherein a tendency similar to Table 1 was displaced.

The invention claimed is:

1. A golf club comprising: a golf club shaft; and a golf club head with a hollow structure fixed to a tip end of the golf club shaft and including a face portion having a face for hitting a ball, wherein the golf club has a reverse flex of 80 to 110 mm, the face portion has an area centroid SG which is that of the back surface of the face portion, and the face portion includes a central thick part provided in a central region of the face portion, the central thick part having an area of not less than 10% and not more than 35% of the overall area of a back surface of the face portion and the central thick part having a substantially constant thickness largest in the face portion, a toe-crown-side thin part provided on a crown-side and on a toe-side of the central thick part, the toe-crown-side thin part being formed in a region between two straight lines intersecting at an area centroid SG at an angle αA of not less than 30 degrees and not more than 55 degrees, the toe-crown-side thin part having an area of not less than 5% and not more than 9% of the overall area of the back surface of the face portion and the toe-crown-side thin part having a substantially constant thickness smallest in the face portion, and a heel-sole-side thin part provided on a sole-side and on a heel-side the central thick part, the heel-sole-side thin part being formed in a region between two straight lines intersecting at the area centroid SG at an angle αB of not less than 30 degrees and not more than 50 degrees, the heel-sole-side thin part having an area of not less than 3% and not more than 8% of the overall area of the back surface of the face portion and the heel-sole-side thin part having a substantially constant thickness smallest in the face portion, and in a front view of the golf club in its standard state in which the golf club is put on a horizontal plane at a lie angle and loft angle which are specified for the golf club, a first straight line passing an area centroid of the toe-crown-side thin part and an area centroid of the back surface of the face portion has an angle θA of 38 to 45 degrees with respect to the horizontal plane, and a second straight line passing an area centroid of the heel-sole-side thin part and the area centroid of the back surface of the face portion has an angle θB of 40 to 45 degrees with respect to the horizontal plane.

2. The golf club according to claim 1, wherein the toe-crown-side thin part and the heel-sole-side thin part have a thickness of 1.8 to 2.4 mm.

3. The golf club according to claim 1, wherein the volume of the golf club head is 400 to 470 cc.

4. The golf club according to claim 1, wherein the golf club head is of a wood-type.

5. The golf club according to claim 1, wherein the area of the toe-crown-side thin part is more than the area of the heel-sole-side thin part.

6. The golf club according to claim 1, wherein the central thick part is composed of a base which is generally a horizontally long oval along the contour shape of the peripheral edge of the back surface of the face portion, an upward rib extending from an upper part of the base on its heel-side to the crown-side peripheral edge of the back surface of the face portion while inclining to the heel-side, and a downward rib extending from a lower part of the base on its toe-side to the sole-side peripheral edge of the back surface of the face portion while inclining to the toe-side.

7. The golf club according to claim 6, wherein the thickness of the upward rib and the thickness of the downward rib are substantially the same as the thickness of the base.

8. The golf club according to claim 6, wherein the thickness of the upward rib is gradually decreased toward the crown-side, and the thickness of the downward rib is gradually decreased toward the sole-side.

* * * * *